US006139293A

United States Patent [19]

Iizuka et al.

[11] Patent Number: 6,139,293

[45] Date of Patent: Oct. 31, 2000

[54] ROTATION INHIBITING MECHANISM FOR MOVABLE SCROLL OF SCROLL TYPE FLUID MACHINE

[75] Inventors: Jiro Iizuka, Takasaki; Ohtake Shinichi, Ashikaga, both of Japan

[73] Assignee: Sanden Corporation, Gunma, Japan

[21] Appl. No.: 09/236,551

[22] Filed: Jan. 26, 1999

[30] Foreign Application Priority Data

Jan. 27, 1998 [JP] Japan ..... 10-013874

[51] Int. Cl.[7] ..... F01C 1/04

[52] U.S. Cl. ..... 418/55.3; 464/103

[58] Field of Search ..... 418/55.3; 464/103

[56] References Cited

U.S. PATENT DOCUMENTS

| | | | |
|---|---|---|---|
| 3,647,268 | 3/1972 | Haines . | |
| 4,259,043 | 3/1981 | Hidden et al. | 418/55.3 |
| 4,406,600 | 9/1983 | Terauchi et al. | 418/55.3 |
| 4,457,674 | 7/1984 | Kawano et al. | 418/5 |
| 4,457,676 | 7/1984 | Hiraga | 418/57 |
| 4,468,181 | 8/1984 | Sakamoto | 418/55.3 |
| 4,472,120 | 9/1984 | McCullough | 418/83 |
| 4,474,543 | 10/1984 | Hiraga et al. | 418/55.3 |
| 4,492,543 | 1/1985 | Iimori et al. | 418/55.3 |
| 4,527,963 | 7/1985 | Terauchi | 418/100 |
| 4,545,746 | 10/1985 | Sugimoto | 418/55.3 |
| 4,589,828 | 5/1986 | Sato et al. | 418/55.3 |
| 4,626,179 | 12/1986 | Terauchi . | |
| 4,645,435 | 2/1987 | Sugimoto | 418/55.3 |
| 4,934,909 | 6/1990 | Suzuki et al. | 418/55.3 |
| 5,102,315 | 4/1992 | Terauchi | 418/55.3 |
| 5,221,198 | 6/1993 | Izumi et al. | 418/55.3 |
| 5,423,663 | 6/1995 | Fukui | 418/55.3 |
| 5,738,504 | 4/1998 | Kitano | 418/55.3 |
| 5,911,566 | 6/1999 | Terauchi et al. | 418/55.3 |

FOREIGN PATENT DOCUMENTS

| | | |
|---|---|---|
| 0049881 | 4/1982 | European Pat. Off. . |
| 0123407 | 10/1984 | European Pat. Off. . |
| 2455196 | 11/1980 | France . |
| 63-179185 | 7/1988 | Japan . |
| 63-266214 | 11/1988 | Japan . |
| 5-033811 | 2/1993 | Japan . |
| 5-87131 | 4/1993 | Japan . |
| 5-126140 | 5/1993 | Japan . |
| 7-019249 | 1/1995 | Japan . |
| 9-310685 | 2/1997 | Japan . |

OTHER PUBLICATIONS

Patent Abstract of Japan, Publication No. 63280882, published Nov. 17, 1988.

*Primary Examiner*—John J. Vrablik
*Attorney, Agent, or Firm*—Baker Botts L.L.P.

[57] ABSTRACT

A movable race 25 fixed to a movable scroll 20 which revolves with respect to a fixed scroll and a fixed race 24 opposing the movable race are respectively provided with pluralities of annular ball rolling grooves 24*c* and 25*c* extending along the revolutionary locus of the movable scroll and a plurality of balls 26 are held sandwiched between the plurality of ball rolling grooves of the movable race and the plurality of ball rolling grooves of the fixed race. Further, the radius of revolution S1 to be obtained by the movable race, the plurality of balls, and the fixed race is made smaller than the radius of revolution S2 to be determined by the scroll wall of the movable race and that of the fixed race.

5 Claims, 8 Drawing Sheets

$S1 < S2$ $S1 = (A/2) + (B/2)$ $S1 < S2$ $S1 = (A/2) + (B/2)$

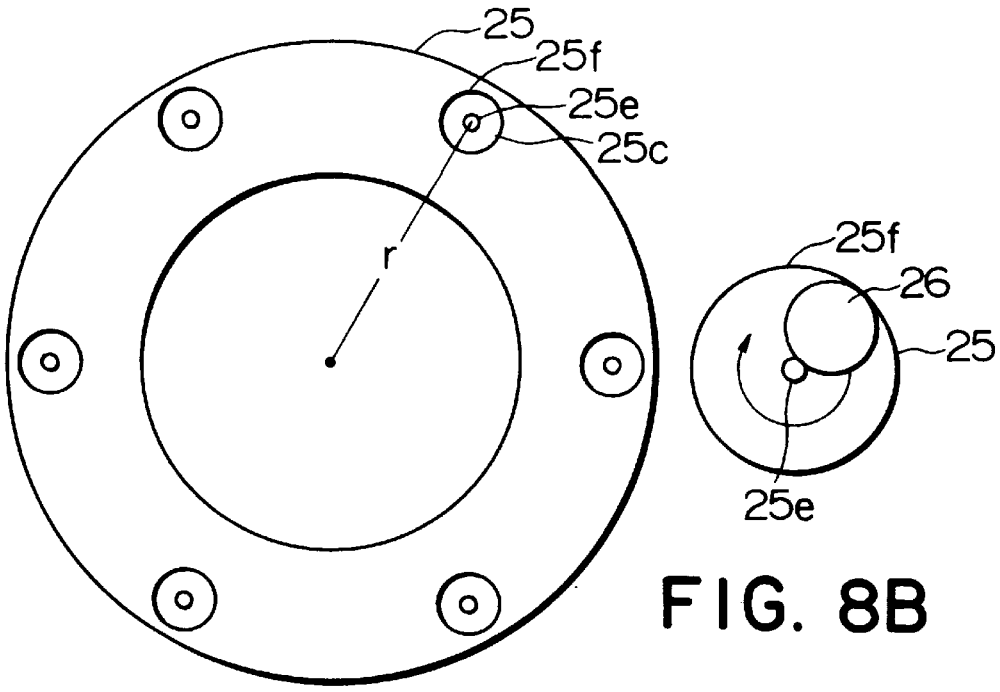
FIG. 8B
FIG. 8A
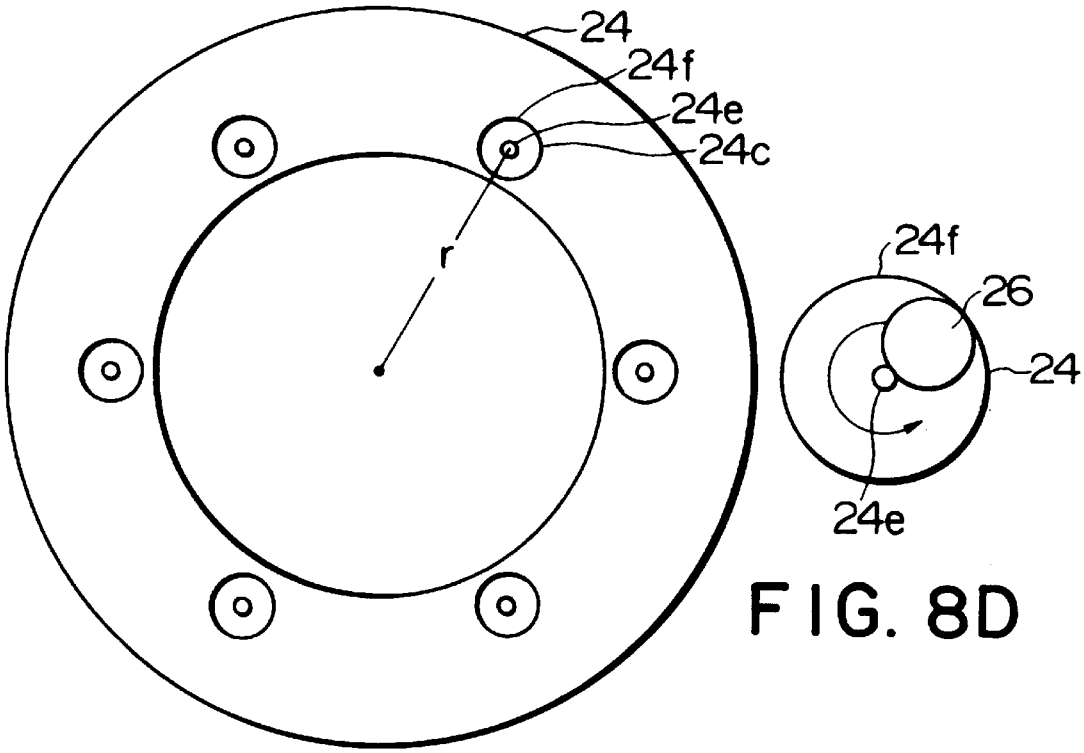
FIG. 8D
FIG. 8C

ROTATION INHIBITING MECHANISM FOR MOVABLE SCROLL OF SCROLL TYPE FLUID MACHINE

BACKGROUND OF THE INVENTION

The present invention relates to a scroll type fluid machine such as a compressor, a vacuum pump or an expander and more particularly, to a mechanism for inhibiting rotation of a movable scroll of the fluid machine revolving at the time of operation of the fluid machine.

A rotation inhibiting mechanism for the movable scroll of a prior art scroll type compressor described in Japanese Patent Unexamined Publication (JP-A) No. 310685/1997 will be described.

At the outset, a first technology of the prior art scroll type compressor will be described by referring to FIGS. 1 through 3. In FIG. 1, a housing 10 of the scroll type compressor is provided with a rear housing 10*a* in the shape of a large-diameter bottomed cylinder and a front housing 10*b* formed of a large-diameter cylindrical portion 10*b*1 and a small-diameter cylindrical portion 10*b*2 and fixed to an open end of the rear housing 10*a*. Further, the rear housing 10*a* and the front housing 10*b* are arranged concentric with each other.

Further, a shaft 11 extends into the housing 10 along the central axis X of the latter through the small-diameter cylindrical portion 10*b*2 of the front housing 10*b*. The shaft 11 is provided with a small-diameter portion 11*a* surrounded by the small-diameter cylindrical portion 10*b*2 of the front housing 10*b* and a large-diameter portion 11*b* surrounded by the large-diameter cylindrical portion 10*b*1. To one end surface of the large-diameter portion 11*b* there is fixed a driving pin 12 extending parallel to, and eccentric with, the axis X. The shaft 11 is rotatably supported by the large-diameter cylindrical portion 10*b*1 of the front housing 10*b* through a ball bearing 13 while the small-diameter portion 11*a* is rotatably supported by the small-diameter cylindrical portion 10*b*2 of the front housing 10*b* through a ball bearing 14.

At a position radially and outwardly of the small-diameter cylindrical portion 10*b*2 of the front housing 10*b* there is arranged an electromagnetic clutch 15. The electromagnetic clutch 15 rotatably fits about the small-diameter cylindrical portion 10*b*2 of the front housing 10*b* and is provided with a pulley 15*a* connected to an external driving source (not shown) by means of a V-belt (not shown), an exciting coil 15*b* fixed to the small-diameter cylindrical portion 10*b*2 and a rotation transmitting plate 15*c* fixed to one end of the small-diameter portion 11*a* of the shaft 11. Thus, the shaft 11 is rotated by the external driving source (not shown) through the electromagnetic clutch 15.

Within the rear housing 10*a* there is arranged a fixed scroll 16.

The fixed scroll 16 is provided with a disk-shaped end plate 16*a* which fits in the rear housing 10*a* arranged coaxially with the axis X, a spiral body 16*b* formed on one of the surfaces of the end plate 16*a* and legs 16*c* formed on the other surface of the end plate 16*a*. At the center of the end plate 16*a* there is formed a discharge hole 16*a*1. The fixed scroll 16 is fixed to the rear housing 10*a* by means of bolts 17 while the legs 16*c* are held in contact with the bottom 10*a*1 of the rear housing 10*a*. The space within the rear housing 10*a* is divided into an intake chamber 18 and a discharge chamber 19 by means of the end plate 16*a* of the fixed scroll 16.

Within the rear housing 10*a* there is disposed a movable scroll 20 as a revolving member lying adjacent to the fixed scroll 16. The movable scroll 20 is provided with a disk-shaped end plate 20*a*, a spiral body 20*b* formed on one of the surfaces of the end plate 20*a* and an annular boss 20*c* formed on the other surface of the end plate 20*a*. The central axis of the end plate 20*a* is eccentric with the axis X. The spiral body 20*b* of the movable scroll 20 engages with the spiral body 16*b* of the fixed scroll 16.

Within the boss 20*c* there is rotatably fitted, through a needle bearing 22, a thick disk-shaped bush 21 disposed concentric with the end plate 20*a*. Further, the bush 21 is provided with an eccentric through hole 21*a* extending parallel to the axis X and a balance weight 23 extending in the radial direction is fixed to the bush 21. The through hole 21*a* houses the driving pin 12 fixed to the large-diameter portion 11*b* of the shaft 11 so as to allow the pin 12 to slide therein.

A fixed race 24 is fixed to one end of the large-diameter cylindrical portion 10*b*1 of the front housing 10*b* and a movable race 25 is fixed to the end plate 20*a* of the movable scroll 20. Further, a plurality of balls 26 are interposed between the fixed race 24 and the movable race 25 in spaced apart relationships with one another in the circumferential direction and a ball coupling for preventing the rotation of the movable scroll 20, that is, a rotation inhibiting mechanism is constructed by these races 24 and 25 and the plurality of balls 26.

The above-described ball coupling will be described with reference to FIGS. 2A and 2B. Each of the fixed race 24 and the movable race 25 is formed by a press using a ferrous material and is in the shape of an annular ring. The fixed race 24 is provided on one of the surfaces thereof with a plurality of annularly extending ball rolling grooves 24*c* which are spaced apart from one another in the circumferential direction and likewise, the movable race 25 is provided on one of the surfaces thereof with a plurality of annularly extending ball rolling grooves 25*c* which are spaced apart from one another in the circumferential direction. The balls 26 are made of a bearing steel material and are interposed between the fixed race 24 and the movable race 25 in a state in which they are held sandwiched by the rolling grooves 24*c* of the fixed race 24 and the opposing ball rolling grooves 25*c* of the movable race 25.

To continue to describe further the present invention by referring to FIG. 3, the inner surface of the ball rolling groove 24*c* includes an inner peripheral portion 24*c*1 having a curved surface of a radius of curvature R1, an outer peripheral portion 24*c*2 having a curved surface of a radius of curvature of R2 and a bottom portion 24*c*3 connecting the portions 24*c*1 and 24*c*2 while the inner surface of the ball rolling groove 25*c* includes an inner peripheral portion 25*c*1 having a curved surface of a radius of curvature of R1, an outer peripheral portion 25*c*2 having a curved surface of a radius of curvature of R2 and a bottom portion 25*c*3 connecting the portions 25*c*1 and 25*c*2. The radius of curvature R1 and the radius of curvature R2 may be the same or somewhat different from each other. Anyway, the radii of curvature R1 and R2 bear close resemblance to the radius of each of the balls 26 and are set to a value slightly larger than the value of the radius of the ball 26.

The bottom portions 24*c*3 and 25*c*3 are each in the form of a flat surface so as to become tangential to the inner peripheral portions 24*c*1 and 25*c*1 and the outer peripheral portions 24*c*2 and 25*c*2, respectively. In other words, the bottom portions 24*c*3 and 25*c*3 form themselves geometrical curved surfaces of large radii of curvature gently connecting the inner peripheral portions 24*c*1 and 25*c*1 to the outer peripheral portions 24c2 and 25c2, respectively. The central diameter of each of the curved bottom portions 24c3 and 25c3 is set to a value substantially identical with the radius of revolutionary motion of the movable scroll 20. Further, the size of the width of each of the bottom portions 24c3 and 25c3 is set to one-third of the width of the effective ball rolling locus and it is desirable to set this size to a value which is determined in anticipation of an error of the shape of each of the scrolls of the scroll type compressor, an error of the attachment position of each of the races and an error of the position of each of the ball rolling grooves.

On the other hand, on the other surfaces of the fixed race 24 and the movable race 25, there are provided flat portions 24d and 25d, respectively. These flat portions 24d and 25d are larger in width than the bottom portions 24c3 and 25c3. Accordingly, the fixed race 24 and the movable race 25 are brought into contact with, and supported by, the large-diameter cylindrical portion 10b1 of the front housing 10b and the end plate 20a of the movable scroll 20 as race support members, over a width larger than the width of each of the bottom portions 24c3 and 25c3.

Returning to FIG. 1, the operation of the scroll type compressor provided with the above-described ball coupling will be described. The shaft 11 of the compressor is rotated by the external drive source (not shown) through the electromagnetic clutch 15. When the shaft 11 is rotated, the bush 21 revolves about the axis X and the movable scroll 20 revolves about the axis X. Thus, by the revolution of the movable scroll 20, the space formed between the spiral body 20b of the movable scroll 20 and the spiral body 16b of the fixed scroll 16, that is, a compression chamber shifts toward the center of the spiral body 16b as it reduces its capacity. As a result, a fluid flowed into the intake chamber 18 from an external fluid circuit through the intake port (not shown) formed in the housing 10 is taken into the compression chamber from the outer peripheral ends of both of the spiral bodies 16b and 20b, compressed within the compression chamber and flows out into the discharge port 19 through the discharge hole 16a1 formed in the fixed scroll 16. The pressurized fluid flowed into the discharge chamber 19 then flows outside the external fluid circuit through the discharge port (not shown) formed in the rear housing 10a.

The reaction force applied on the movable scroll 20 in the direction of the axis X and the movable scroll rotation inhibiting force in the radial direction at the time when the fluid is compressed are transmitted to the front housing 10b through the movable race 25, each of the balls 26 and the fixed race 24.

With the revolution of the movable scroll 20, each of the balls 26 rolls within the ball rolling grooves 24c and 25c as it draws a circular orbit having a diameter substantially the same as the radius of revolution of the movable scroll 20. In this case, since the diameter of the bottom portion 24c3 (25c3) of the ball rolling groove 24c (25c) is set to a value substantially the same as the value of the radius of revolution of the movable scroll 20, each of the balls 26 can roll smoothly within the ball rolling grooves 24c and 25c as it draws a circular orbit of a diameter substantially equal to the radius of revolution of the movable scroll 20 in a state in which it is pressed against the bottom portions 24c3 and 25c3 of the ball rolling grooves 24c and 25c, respectively. As a result, the movable scroll 20 revolves while it keeps a predetermined angular relationship with the front housing 10b, and in the end, with the fixed scroll 16.

When the movable scroll 20 revolves, the movable scroll 20 tends to rotate about the bush 21. However, since the rolling range of each of the balls 26 is limited to the interior of ball rolling grooves 24c and 25c, the rotation of the movable scroll 20 is inhibited.

In the above case, each of the balls 26 rolls generally along the bottom portions 24c3 and 25c3 of the rolling grooves 24c and 25c, respectively. Further, the lines of action of thrust forces F0 acting on the fixed and movable races 24 and 25, respectively, from the ball 26 generally coincide with each other along the axial direction.

A ball coupling as a rotation inhibiting mechanism according to a second prior art technology will be described with reference to FIG. 4 wherein like parts are designated by like reference numerals with respect to the ball coupling shown in FIGS. 2A and 2B and FIG. 3 without repeating the description thereof.

In the case of the ball coupling shown in FIG. 4, the radius of curvature R3 of the bottom portion 24c3 (25c3) of the ball rolling groove 24c (25c) of the fixed race 24 (the movable race 25) is set to a value far larger than any of the radius of curvature R1 of the inner peripheral portion 24c1 (25c1) of the fixed race 24 (the movable race 25) and the radius of curvature R2 of the outer peripheral portion 24c2 (25c2) of the fixed race 24 (the movable race 25). However, it goes without saying that the bottom portion 24c3 (25c3) is so formed as to become tangential to the inner peripheral portion 24c1 (25c1) and the outer peripheral portion 24c2 (25c2). Thus, according to this structure, the inner surfaces of the ball rolling grooves 24c and 25c are continuously curved so that it is possible to prevent the surface pressure from rising up locally. It is noted that the radius of curvature R1 and the radius of curvature R2 may be identical with, or somewhat different from, each other.

The bottom portion 24c3 (25c3) of the ball rolling groove 24c (25c) is not always required to be flat. That is, where the inner peripheral portion 24c1 (25c1) and the outer peripheral portion 24c2 (25c2) are made to form curved surfaces whose radii of curvature are R1 and R2, respectively, the bottom portion 24c3 (25c3) may be made to form a geometrical curved surface whose radius of curvature is larger than any of the radii of curvature of R1 and R2.

A prior art ball coupling as a rotation inhibiting mechanism according to a third prior art technology will be described with reference to FIG. 5 wherein parts similar to those of the ball coupling shown in FIGS. 3 and 4 are designated by the same reference numerals without repeating the description thereof.

In the case of the ball coupling shown in FIG. 5, the inner surface of each of the ball rolling grooves 24c (25c) of the fixed race 24 (the movable race 25) is curved in the form of an annular ellipse having its major axis in the radial direction. In other words, the inner surface of each of the ball rolling grooves 24c (25c) of the fixed race 24 (the movable race 25) is formed by one half portion, or a part, of an ellipse having two foci obtained by dividing the ellipse by its major axis. Thus, in this way also, the inner surface of the ball rolling groove 24c (25c) becomes continuously curved so that it is possible to prevent the surface pressure from rising locally.

The formation of the above-described inner curved surface of each of the ball rolling grooves 24c (25c) will be described more specifically with FIG. 6. Assuming that the diameter of each of the balls 26 is expressed by d, the distance H from the bottom of the ball rolling groove 25c up to the foci f1 and f2 of an ellipse, the following equation (1) will be satisfied.

$$H=(d/2)+r \quad (1)$$

wherein $r \geqq 0$.

Further, assuming that the distances from one of the surfaces of the movable race 25 to the two foci f1 and f2 are A1 and B1, the distances from the bottom of the ball rolling grooves 25*c* to the two foci f1 and f2 are A2 and B2, and the space between the foci f1 and f2 is C1, the following equation (2) will be established:

$$A1+B1+C1=A2+B2+C1 \quad (2).$$

Accordingly, it is possible to obtain the positions of f1 and f2 of the ellipse when the inner surface of each of the ball rolling grooves 25*c* of the movable race 25 can be formed.

It should be noted that although the movable race 25 is shown in FIG. 6, the same process can be taken when the inner surface of each of the ball rolling grooves 24*c* of the fixed race 24 is formed.

In the case of the rotation inhibiting mechanism of the movable scroll of the prior art scroll type compressor, there exists the relationship of S1=S2 between the radius of revolution S1 to be obtained by the movable race, the plurality of balls, and the fixed race and the radius of revolution (the radius of turning of the movable scroll) S2 to be determined by the scroll walls of the movable scroll and the fixed scroll. However, when S1=S2, each of the balls comes into contact with each of the bottoms of the ball rolling grooves of the movable and fixed races and so the contact surface pressure of each of the balls and each of the movable and fixed races becomes minimum so that the abrasion and deformation of the rotation inhibiting mechanism rarely take place and the durability of the mechanism increases.

However, the manufacture of the parts of the scroll type compressor to satisfy the relationship of S1=S2 requires a high degree of accuracy so that the manufacturing cost increases thereby making it difficult to manufacture the machine on a large scale.

SUMMARY OF THE INVENTION

Accordingly, an object of the present invention is to provide a rotation inhibiting mechanism for a movable scroll of a scroll type fluid machine in which the contact surface pressure between each of movable and fixed races is considerably small.

Another object of the invention is to provide a rotation inhibiting mechanism for a movable scroll of a scroll type fluid machine suitable for a large-scale production.

According to the present invention, there is provided a rotation inhibiting mechanism for a movable scroll of a scroll type fluid machine comprising a fixed scroll having a fixed race provided with a plurality of annular ball rolling grooves extending along a revolutionary locus of the movable scroll, the movable scroll revolving with respect to the fixed scroll and having a movable race fixed to the movable scroll and provided with a plurality of annular ball rolling grooves extending along the revolutionary locus of the movable scroll, the fixed race opposing to the movable race and provided with a plurality of balls sandwiched between the ball rolling grooves of the movable race and those of the fixed race, wherein when the radius of revolution obtained by the movable race, the plurality of balls and the fixed race is S1 and the radius of revolution determined by the walls of the fixed and movable scrolls is S2, the relationship of S1<S2 is established.

BRIEF DESCRIPTION OF THE DRAWING

FIG. 8A is a front view (on a reduced scale) of a movable race of the movable scroll according to the embodiment of the invention shown in FIG. 7;

FIG. 8B is an illustrative view showing how each of balls moves within a plurality of ball rolling grooves of the movable race shown in FIG. 8A;

FIG. 8C is a front view (on a reduced scale) of a fixed race of the compressor shown in FIG. 7; and FIG. 8D is an illustrative view showing how each of balls moves within a plurality of ball rolling grooves of the fixed race shown in FIG. 8C.

DESCRIPTION OF THE PREFERRED EMBODIMENT

A scroll type compressor provided with a ball coupling as a rotation inhibiting mechanism for a movable scroll of the compressor according to one embodiment of the present invention will be described.

Figure 1:
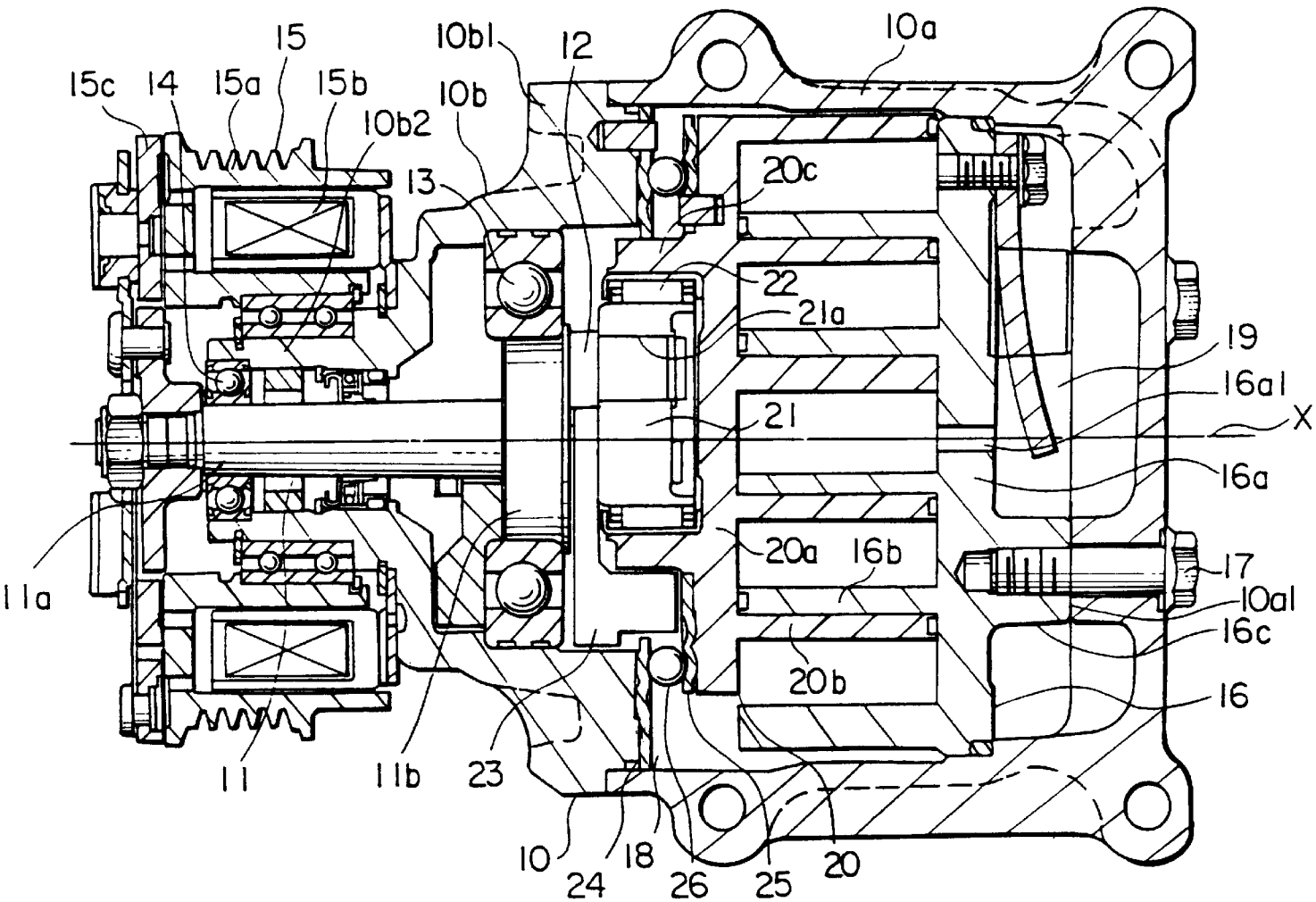
FIG. 1 PRIOR ART
FIG. 1 is a vertical sectional view of a prior art scroll type compressor which is provided with a rotation inhibiting mechanism for a movable scroll according to a first prior art technology.
Figure 2B:
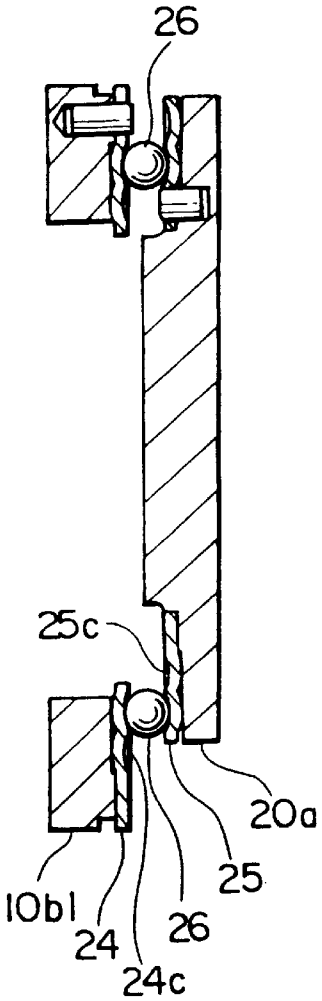
FIG. 2B PRIOR ART
FIG. 2B is a cross-sectional view of the rotation inhibiting mechanism for the movable scroll according to the first prior art technology.
Figure 2A:
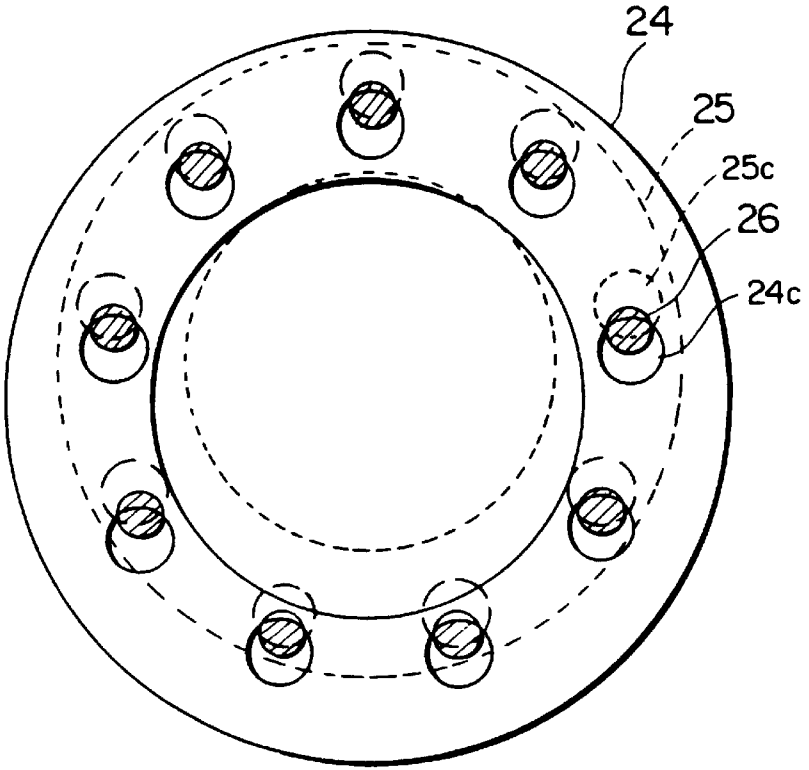
FIG. 2A PRIOR ART
FIG. 2A is a front view of the rotation inhibiting mechanism for the movable scroll according to the first prior art technology.
Figure 3:
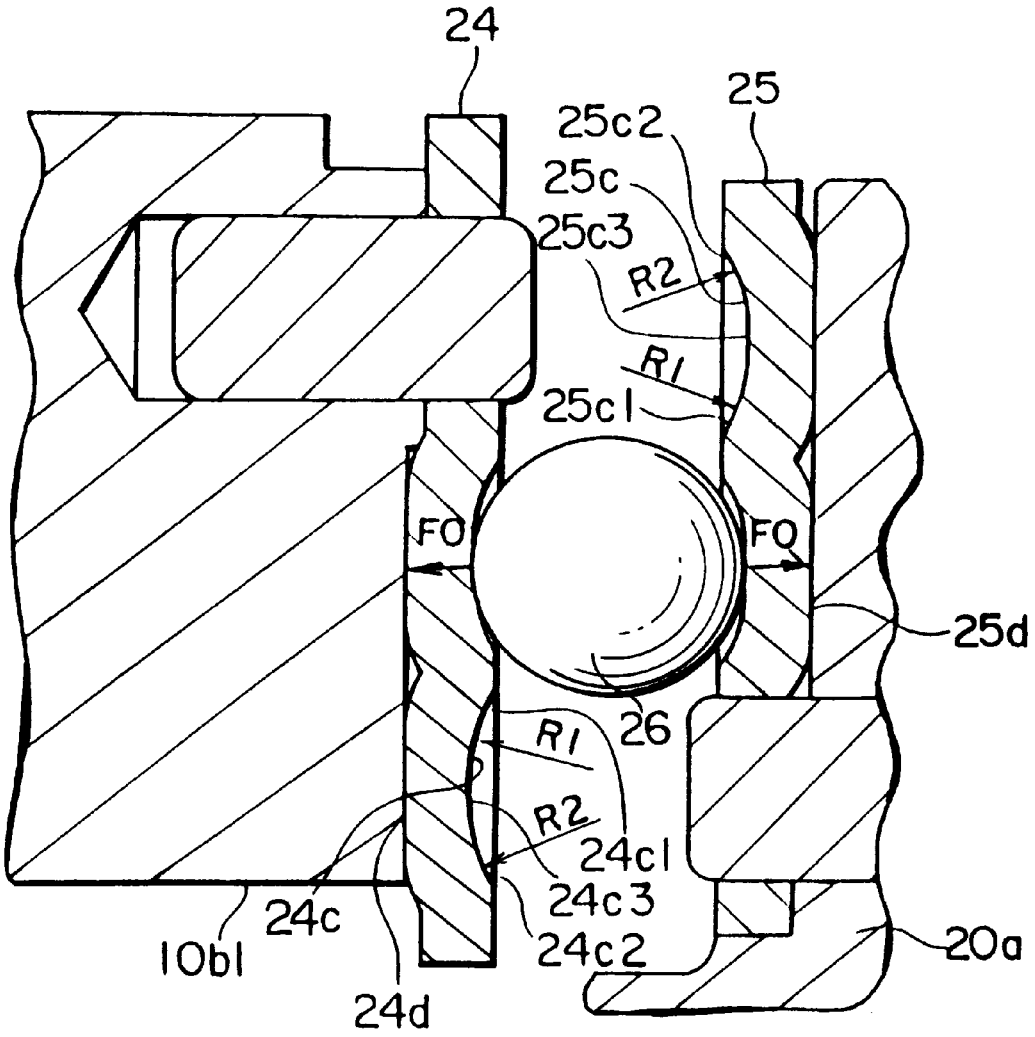
FIG. 3 PRIOR ART
FIG. 3 is an enlarged sectional view of an essential portion of the rotation inhibiting mechanism for the movable scroll according to the first prior art technology.
Figure 4:
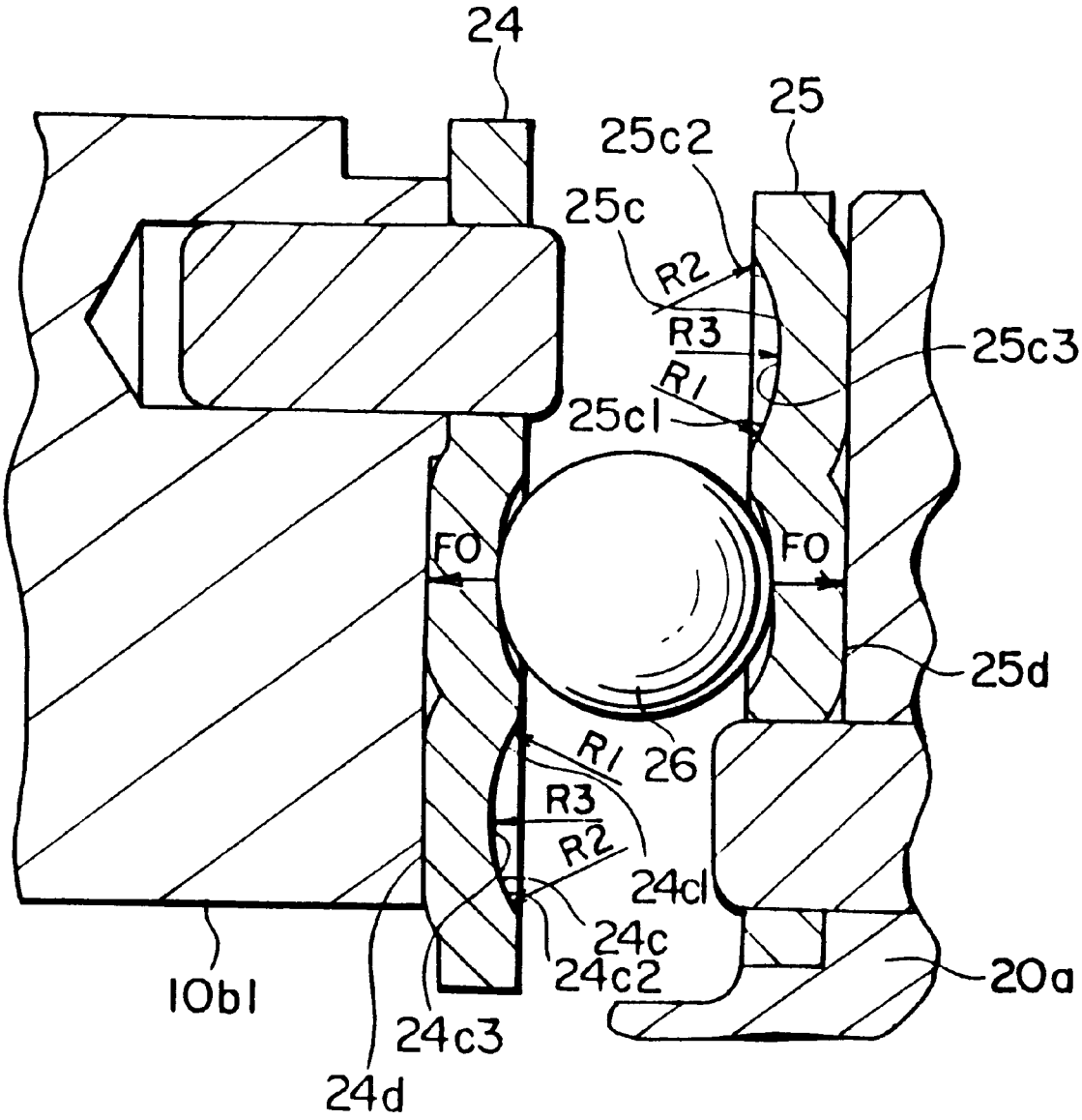
FIG. 4 PRIOR ART
FIG. 4 is an enlarged sectional view of an essential portion of a rotation inhibiting mechanism for a movable scroll of a scroll type compressor according to a second prior art technology.
Figure 5:
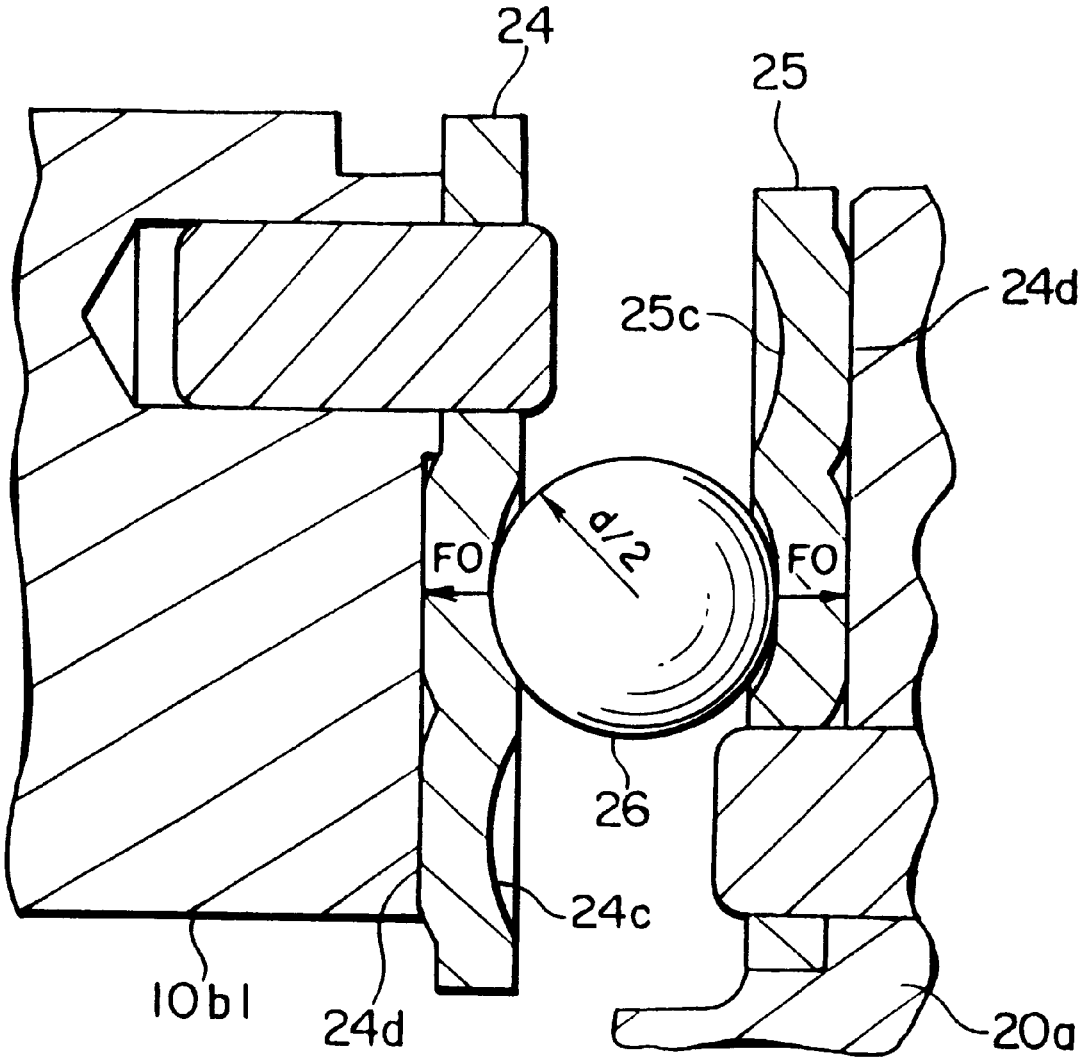
FIG. 5 PRIOR ART
FIG. 5 is an enlarged sectional view of an essential portion of a rotation inhibiting mechanism for a movable scroll of a scroll type compressor according to a third prior art technology.
Figure 6:
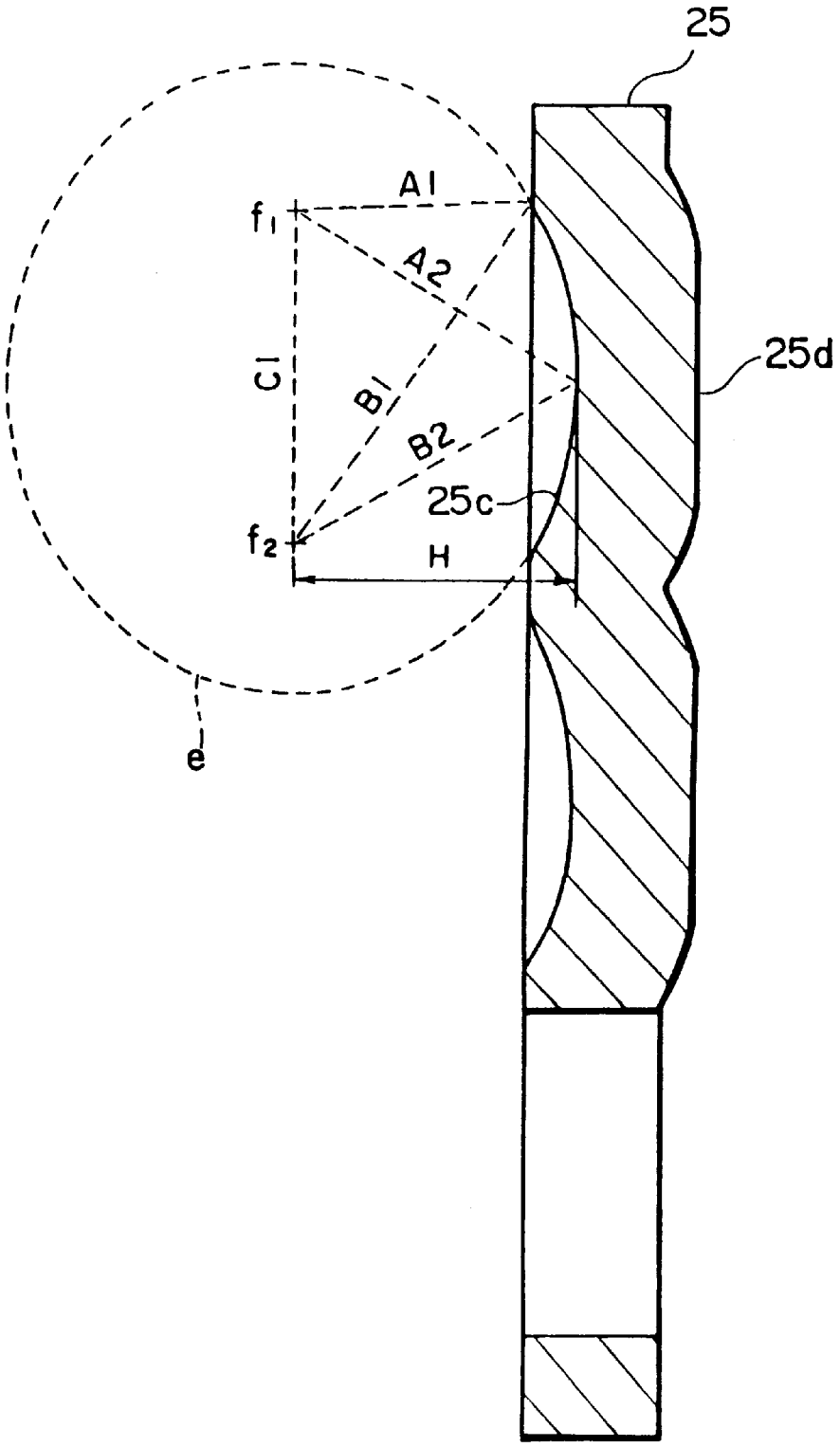
FIG. 6 PRIOR ART
FIG. 6 is an illustrative view of the essential portion of the rotation inhibiting mechanism for the movable scroll according to the third prior art technology.
Figure 7:
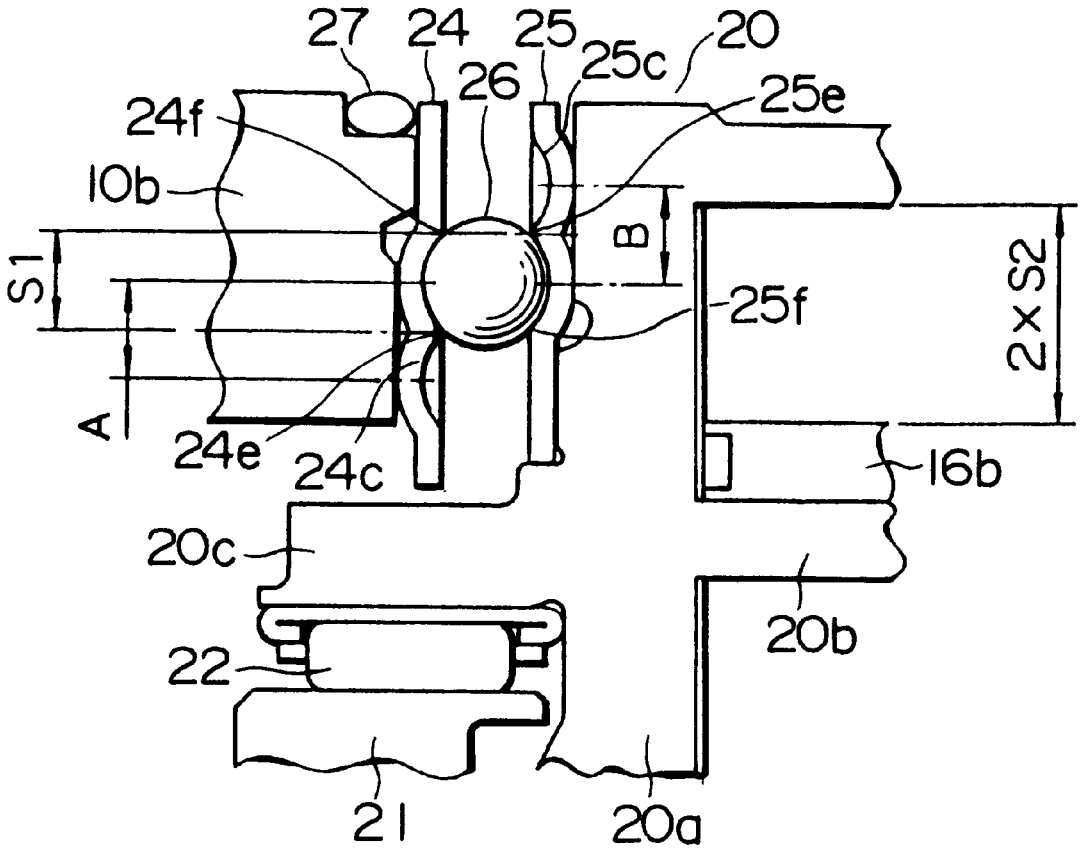
FIG. 7 is a sectional view of an essential portion of a rotation inhibiting mechanism for a movable scroll of a scroll type compressor according to one embodiment of the present invention.

The basic structure of the scroll type compressor according to one embodiment of the invention is the same as that of the prior art scroll type compressor. Therefore, the essential point of this embodiment will be described by referring to FIG. 7 and FIGS. 8A through 8D. The rotation inhibiting mechanism for the movable scroll does not allow the movable scroll to rotate although it allows the movable scroll to revolve and it is arranged between the movable scroll and a front housing. In FIG. 7, a spiral body 20*b* of the movable scroll 20 engages with a spiral body 16*b* of a fixed scroll. An end plate 20*a* of the movable scroll 20 and a thick disk-shaped bush 21 are arranged concentric with each other and the bush 21 rotatably fits into a boss 20*c* of the movable scroll 20 through a needle bearing 22.

To the end plate 20*a* of the movable scroll 20 on the side of the front housing 10*b* there is fixed a movable race 25 shown in FIG. 8A and to the front housing 10*b* on the side of the movable scroll 20 there is fixed a fixed race 24 shown in FIG. 8C. Further, between six ball rolling grooves 25*c* of the movable race 25 and six ball rolling grooves 24*c* of the fixed race 24 there are interposed balls 26, respectively. An O-ring 27 is disposed between the front housing 10*b* and a rear housing.

In FIG. 8A, on the circumference of the ring-shaped movable race 25 having a radius r, there are provided the six annular ball rolling grooves 25*c* at equal intervals. At the center of each of the ball rolling grooves 25*c* there is formed a projection 25*e* about which the ball rolls. Similarly, in FIG. 8C, on the circumference of the ring-shaped fixed race 24 there are provided the six circular ball rolling grooves 24*c* at equal intervals. At the center of each of the ball rolling grooves 24*c* there is formed a projection 24*e* about which the ball rolls.

The rotation inhibiting mechanism for the movable scroll comprises the movable race 25, the six balls 26 and the fixed race 24. Assuming that the radius of revolution of the movable scroll 20 obtained by the rotation inhibiting mechanism is S1, the radius of revolution (the radius of turning of the movable scroll) determined by the scroll walls of the movable and fixed scrolls 20 and 16 is S2, the diameter of the circumferential track of each of the balls 26 in each of the ball rolling grooves 24*c* of the fixed race 24 is A and the diameter of the circumferential track of each of the balls 26 in each of the ball rolling grooves 25*c* of the movable race 25 is B, the following relationships will be established in the present invention:

$$S1=(A/2)+(B/2)$$

$$S1>S2$$

According to an experiment, the difference between S1 and S2 is desired to be within the range of 0.3 mm.

Further, since the sectional configuration of each of the ball rolling grooves 25*c* of the movable race 25 and that of each of the ball rolling grooves 24*c* of the fixed race 24 is curved in the shape of a circular arc or in a shape closely resembling a circular arc, the rotation inhibiting mechanism can be manufactured with ease. In addition, the amount of running of each of the balls on the outer edges 24*f* and 25*f* of the ball rolling grooves 24*c* and 25*c* due to the difference between S1 and S2 is below the minimum resolution of a casing shim used for adjusting the gap between the movable scroll and the fixed scroll of the compressor in the axial direction, the productivity of the compressor does not lower. Moreover, the variation of the contact angle of each of the balls 26 with respect to the fixed and movable races 24 and 25 when the ball runs on the above-mentioned outer edges of the ball rolling grooves 24*c* and 25*c* is small so that no so strong component force as to interfere with the favorable contact between the scroll wall of the movable scroll 25 and the scroll wall of the fixed scroll 24 at the time of compressing operation generates.

Experimental data regarding the enlargement of the ball contact range and the distribution of the contact surface pressure are shown in the table given below. The mode of contact between each of the balls and the movable and fixed races of the rotation inhibiting mechanism for the movable scroll differs among the cases of S1=S2, S1>S2 and S1<S2. When S1=S2, each of the balls 26 contacts the bottom portions of the ball rolling grooves 24*c* and 25*c* of the fixed and movable races 24 and 25 so that the contact surface pressure of the ball 26 with respect to the fixed and movable races 24 and 25 is minimum. When S1>S2, the ball 26 contacts the central projections 24*e* and 25*e* of the ball rolling grooves 24*c* and 25*c*, the contact surface pressure of the ball 26 with respect to the fixed and movable races 24 and 25 becomes maximum. Lastly, when S1<S2, since the ball 26 contacts the outer edges 24*f* and 25*f* of the rolling grooves 24*c* and 25*c* of the fixed and movable races 24 and 25, the contact area of the ball 26 with respect to the fixed and movable races 24 and 25 becomes larger than when S1>S2, the contact surface pressure of the ball 26 becomes smaller than when S1>S2 and larger than when S1=S2.

TABLE

| | No running-on of ball S1 = S2 | Running of ball on outer edge S1 < S2 | Running of ball on projection S1 > S2 |
|---|---|---|---|
| Contact area | 100% (standard) | 419% | 248% |
| Average pressure | 100% (standard) | 188% | 258% |

According to the Table, it is recognized that, when S1<S2, the ball 26 runs on the outer edge, the average pressure is small, and the contact area is large. In addition, a durability test of the compressor was performed with the difference between S1 and S2 varied at several values from 0 mm to 0.3 mm. As a result, the ball rolling surface of each of the movable and the fixed races peeled earlier as the difference between S1 and S2 approaches to 0.3 mm. From the above, since the ball rolling surface of each of the movable and the fixed races peels early when the difference between S1 and S2 is greater than 0.3 mm, it is desired that the above-mentioned difference is smaller than 0.3 mm (S2−S1<0.3 mm).

As will be clear from the above description, the present invention has the following effects.

1. Since the radius of revolution S1 to be obtained by the rotation inhibiting mechanism comprising the movable race, a plurality of balls and the fixed race is made smaller than the radius of revolution (the radius of turning of the movable scroll) S2 to be determined by the scroll walls of the movable and fixed scrolls, the productivity (with respect to the parts accuracy and assembling accuracy) improves. 2. Since the sectional configuration of the ball rolling grooves of each of the movable and fixed races is made in the form of a simple circular arc or a curved line closely resembling a circular arc, the manufacture of the mechanism is facilitated as compared to the conventional complicated configuration such as an ellipse or a combination of a plurality of curved lines. 3. The surface pressure of contact between each of the balls and each of the movable and fixed races in the present invention is larger than when S1=S2 but the difference is not so large as to cause an actual hindrance and further, the surface pressure is smaller than when S1>S2. Accordingly, the durability of the rotation inhibiting mechanism is improved.

What is claimed is:

1. A rotation inhibiting mechanism for a movable scroll of a scroll type fluid machine comprising: a movable race fixed to a movable scroll which revolves with respect to a fixed scroll and provided with a plurality of annular ball rolling grooves extending along a revolutionary locus of said movable scroll; a fixed race opposing said movable race and provided with a plurality of annular ball rolling grooves same as those of said movable race; and a plurality of balls which are held sandwiched between said plurality of annular ball rolling grooves of said movable race and said plurality of annular ball rolling grooves of said fixed race, characterized in that when a radius of revolution to be obtained by said movable race, said plurality of balls and said fixed race is S1 and a radius of revolution to be determined by scroll walls of said movable scroll and said fixed scroll is S2, a relationship of S1<S2 is established.

2. A rotation inhibiting mechanism for a movable scroll of a scroll type fluid machine as claimed in claim 1, wherein the difference between S1 and S2 is within the range of 0.3 mm.

3. A rotation inhibiting mechanism for a movable scroll of a scroll type fluid machine as claimed in claim 1, wherein when the diameter of a circulating orbit of each of said balls within each of said ball rolling grooves of said fixed race is A and the diameter of a circulating orbit of each of said balls within each of said ball rolling grooves of said movable race is B, an equation of $$S1=(A/2)+(B/2)$$

is established.

4. A rotation inhibiting mechanism for a movable scroll of a scroll type fluid machine as claimed in claim 1, wherein the sectional configuration of each of said plurality of ball rolling grooves is in the form of a circular arc.

5. A rotation inhibiting mechanism for a movable scroll of a scroll type fluid machine as claimed in claim 1, wherein each of said annular ball rolling grooves of said movable and said fixed races is provided with a projection formed at its center so that each of said balls rolls around said projection.

* * * * *